US005090058A

United States Patent [19]

Gerber

[11] Patent Number: 5,090,058

[45] Date of Patent: Feb. 25, 1992

[54] JACKET OR SIMILAR GARMENT

[75] Inventor: Terry L. Gerber, South Bend, Ind.

[73] Assignee: Ashley Worldwide, Inc., Mishawaka, Ind.

[21] Appl. No.: 320,105

[22] Filed: Mar. 6, 1989

[51] Int. Cl.[5] ..... A41D 1/00

[52] U.S. Cl. ..... 2/97

[58] Field of Search ..... 2/108, 97, 93, 272, 2/164, 190, DIG. 2

[56] References Cited

U.S. PATENT DOCUMENTS 2,295,956 9/1942 Lapick ..... 2/97
2,322,510 6/1943 Dufine ..... 2/97
2,554,151 5/1951 Newhouse .
2,586,515 2/1952 Lano .

FOREIGN PATENT DOCUMENTS 520515 6/1953 Belgium ..... 2/97
914443 6/1946 France ..... 2/97

*Primary Examiner*—Werner H. Schroeder
*Assistant Examiner*—Diana L. Biefeld
*Attorney, Agent, or Firm*—Barnes & Thornburg

[57] ABSTRACT

A jacket or similar garment with fixed liner which inlcudes a sleeve configuration such that an opening exists in the fixed liner which provides access to the internal surface of the outer fabric without removal or alteration of the fixed liner. Preferably, this opening is created by an upper flap portion of the fixed liner which extends downwardly beyond and overlaps a lower flap portion, also part of the fixed liner. Side stitching in both the upper flap portion and the lower flap portion tends to reduce the likelihood of twisting and distortion of the fixed liner during use.

24 Claims, 1 Drawing Sheet

FIG. 1
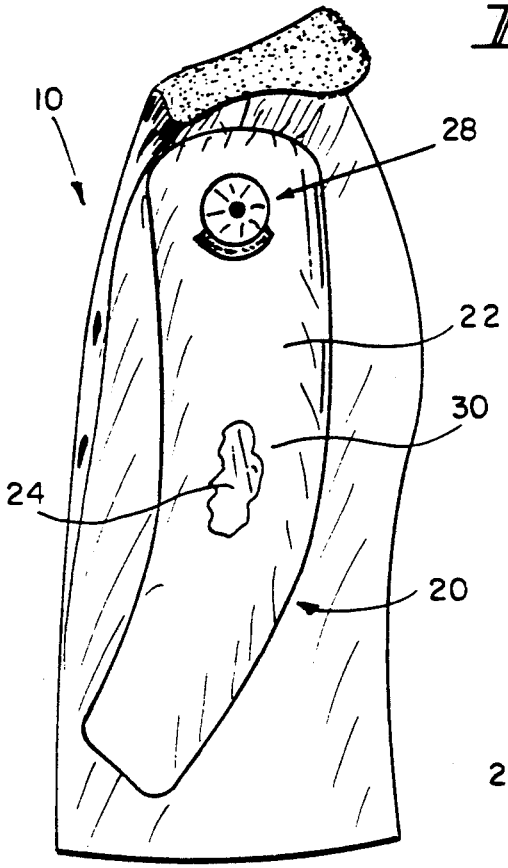
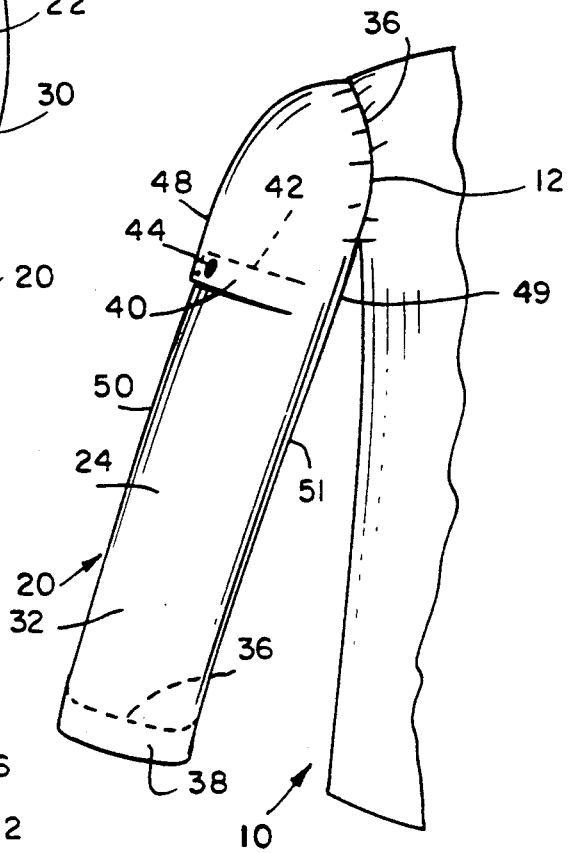
FIG. 2
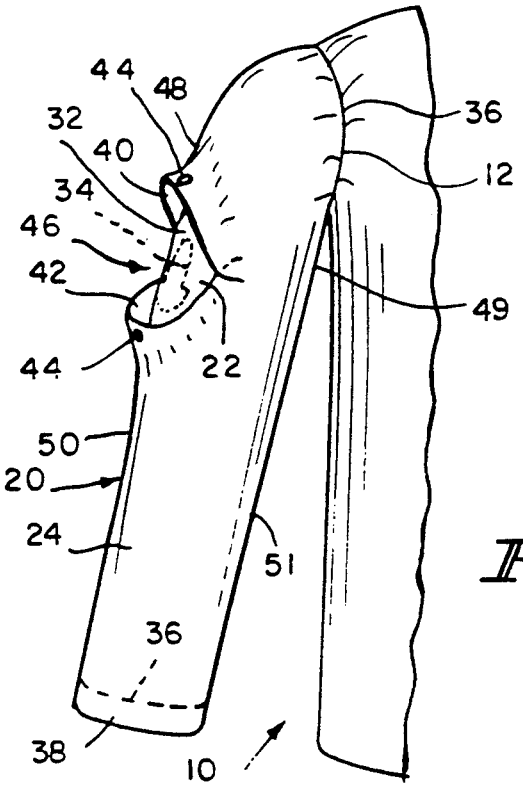
FIG. 3

JACKET OR SIMILAR GARMENT

BACKGROUND AND SUMMARY OF THE INVENTION

The present invention relates generally to jackets or similar garments. More particularly, the present invention relates to sleeve configurations in jackets or similar garments with fixed linings which provide accessibility to interior surfaces of the outer fabric of jackets or similar garments without requiring the removal or alteration of previously secured fixed linings.

It has been a common practice to include fixed linings in jackets or similar garments. Fixed linings traditionally provide several advantages in jackets or similar garments, including protecting the outer fabric from wear, as well as providing an additional layer of fabric material for greater warmth to the wearer in cold environments. In addition, fixed liners can provide a more comfortable, smooth texture against the skin of the wearer, while allowing the outer surface of jackets or other garments to be more durable, and rough in texture. Also, fixed liners can absorb perspiration and carry it away from the wearer's body, while preventing the Perspiration from reaching, and possibly staining, the outer fabric.

It is sometimes desirable to have a patches, decals, badges or other insignias secured to the outer surface of the sleeve of a jacket or similar garment. For example, many professional organizations, such as police, firemen and military personnel, wear identifying insignia on their jacket sleeves to identify the wearer as a member of that particular organization. Also, many individuals wear identifying insignia on their jackets or similar garments to display their loyalty to a particular organization, such as their employer, college or favorite sports team.

Although patches and other insignias can be attached to jackets or similar garments by other means, it is often desirable to stitch the patches and other insignias directly onto the outer fabric of the jackets or similar garments. This does not necessarily cause a problem in jackets or similar garments with a single layer of fabric. However, in jackets or similar garments with a fixed liner, difficulties in attaching patches and other insignias onto the outer fabric can arise. Such fixed liners are often stitched directly to the inside of the sleeves to prevent the fixed liner from being pulled out, or bunched up, when a wearer moves his arm in and out of the sleeve of a jacket or similar garment. When the fixed liner is attached directly to the inside of a sleeve, access to the interior surface of the outer fabric can be blocked.

To remedy this problem, it is sometimes possible to stitch patches and other insignias to the outer surface of a jacket sleeve before securing the fixed liner in place. By stitching patches and other insignias onto the outer fabric independent of the fixed lining, the stitching from the patches and other insignias does not penetrate or interfere with the fixed liner. This technique is suitable when, for example, a manufacturer can stitch patches and other insignias onto jackets or similar garments before shipping the jackets or similar garments. However, in many situations, the manufacturer does not know which patches and other insignias will be preferred by customers, or what quantity of each type of jacket or similar garment to produce. Therefore, a manufacturer would have to maintain a large inventory of completed jackets or similar garments with patches and other insignias stitched before completion or, alternatively, have a long lead time for delivery of customized jackets or similar garments. If the manufacturer could ship out completed jackets or similar garments, complete with stitched-in fixed liners to distributors or customers, and have the distributors or customers install the patches and other insignias, the size and cost of the required inventory could be reduced significantly. It is also desirable for the distributors or customers to have the capability to install patches and other insignias onto these jackets or similar garments with fixed liners in order to provide flexibility in the selection of preferred patches and other insignias.

Previously, distributors and customers could install patches and other insignias on the outer sleeve of a jacket or similar garment by stitching directly through both the outer fabric and the fixed lining. This, however, provides several disadvantages, including deterioration of the visual appearance and functionality of the fixed liner. Also any penetrations through the fabric would extend completely from the exterior of the jacket or similar garment to the interior since the stitching would go through each layer of fabric.

Another alternative method of installing patches and other insignias to the outer sleeve of a jacket or similar garment is to pull the fixed liner away from the outer fabric and hand stitch the patches and other insignias onto the outer fabric layer only. However, hand stitching in this manner is often a difficult and slow task, as it can be difficult to hold the fixed lining away from the outer fabric while stitching the patches and other insignias.

These problems are even more pronounced in jackets or similar garments fabricated from weather resistant fabrics such as the fabric marketed under the trademark GORE-TEX. These types of materials often contain a multitude of microscopic pores. These pores are dimensioned so as to block rain, snow and wind penetration from the exterior, while allowing perspiration vapor to escape through the pores from the interior of the jacket or similar garment. Because of the nature of these materials, they are often exposed to rain and other adverse environments. Any penetration of this type of material, such as penetrations caused by stitching patches and other insignias onto the material, can degrade the effectiveness of this material in blocking out adverse external elements. Conventional methods exist for repairing or sealing small penetrations in these type of materials, including penetrations caused by stitching or other sewing operations. However, these repair or sealing techniques are typically performed on the surface opposite to that on which patches and other insignias are installed. In jackets or similar garments where a fixed liner has previously been installed, the fixed liner often blocks access to this surface.

Accordingly, an object of the present invention is the provision of a jacket or similar garment where patches and other insignias can be stitched onto an exterior surface of the sleeve without interfering with a previously installed fixed liner.

A further object of the present invention is the Provision of a sleeve for a jacket or similar garment with a fixed lining, where patches and other insignias can be stitched onto an exterior surface of the sleeve without necessitating the removal or alteration of the fixed liner.

Still another object of the present invention is to provide a jacket or similar garment with an outer layer fabricated from a weather resistant fabric material, along with a fixed liner, such that penetrations in the weather resistant fabric material can be repaired without necessitating the removal or alteration of the fixed liner.

A still further object of the present invention is the provision of a jacket or similar garment in accordance with the Preceding objects which will conform to conventional forms of manufacture, be of simple construction and easy to fabricate so as to be economically feasible, long-lasting and relative trouble-free during fabrication and use.

These and other objects of the present invention are attained by the provision of a jacket or similar garment with fixed liner which includes a sleeve configuration such that an opening exists in the fixed liner which provides access to the internal surface of the outer fabric without removal or alteration of the fixed liner. Preferably, this opening is created by an upper flap portion of the fixed liner which extends beyond and overlaps a lower flap portion, also part of the fixed liner. Side stitching in both the upper flap portion and the lower flap portion tends to reduce the likelihood of twisting and distortion of the fixed liner during use.

Other objects, advantages and novel features of the Present invention will readily become apparent to those of ordinary skill in the art from the following detailed description of the preferred embodiments of the present invention when considered in conjunction with the accompanying drawings.

BRIEF DESCRIPTION OF THE DRAWINGS

FIG. 1 is a side view of a jacket or similar garment showing a sleeve with a patch or other insignia attached.

FIG. 2 is a partial front view of the inside of a jacket or similar garment with one of its sleeves turned inside out.

FIG. 3 is a partial front view of the inside of a jacket or similar garment with one of its sleeves turned inside out and showing the fixed lining opened to provide access to the interior surface of the outer fabric.

DETAILED DESCRIPTION OF THE PREFERRED EMBODIMENTS

Referring now to the drawings, in which like referenced characters indicate corresponding elements throughout the several views, attention is first directed to FIGS. 1 and 2 which illustrate a preferred embodiment of the present invention. This jacket or similar garment generally consists of body portion 10 having at least one armhole 12 to which sleeve 20 is attached. Sleeve 20 includes generally a cuff or lower portion 38 at the longitudinal end of sleeve 20 opposite the connection of sleeve 20 to arm hole 12.

Fixed liner 24 of the present invention is typically secured to outer fabric 22 of the jacket or similar garment by stitching 36. Fixed liner 24 includes upper flap portion 40 which is secured to outer fabric 22 adjacent arm hole 12 and lower flap portion 42 which is secured to outer fabric 22 adjacent lower portion 38.

Outer fabric 22 is, for example, preferably fabricated from a weather resistant fabric material, such as the fabric marketed under the trademark GORE-TEX. Patch or other insignia 28 is preferably secured to exterior surface 30 of outer fabric 22 by a means such as sewing or stitching 34 which penetrates outer fabric 22.

In the preferred embodiment shown, fixed liner 24 includes upper flap portion 40 which extends beyond and overlaps lower flap portion 42. Upper flap portion 40 is stitched to outer fabric 22 adjacent arm hole 12, and to fixed liner 24 along side portions 48 and 49. Similarly, lower flap portion 42 is stitched to outer fabric adjacent lower portion 38 and to fixed liner 24 along side portions 50 and 51. The amount of overlap between upper flap portion 40 and lower flap portion 42 can be set at any predetermined dimension. However, in certain preferred embodiments, the extent of this overlap is approximately two inches. This degree of overlap, along with the stitching bias along side portions 48, 49, 50 and 51 tends to hold upper flap portion 40 over lower flap portion 42 when the wearer's arm is being pulled from sleeve 20, while still providing opening 46 of sufficient size to interior surface 32.

Opening 46 is preferably dimensioned to be sufficiently large to allow machine stitching of patch or other insignia 28 to exterior surface 30 of outer fabric 22. In certain preferred embodiments, opening 46 is sufficiently large so as to permit the entire sleeve portion of outer fabric 22, from lower portion 38 to arm hole 12, to be pulled through opening 46, thus allowing patch or other insignia 28 to be positioned at any preselected location on exterior surface 30 of outer fabric 22 along sleeve 20. Preferably, the overlap between upper flap portion 40 and lower flap portion 42 is located approximately 80% of the total sleeve 20 length upward and away from lower portion 38. However, those skilled in the relevant art will recognize that this overlap could be located at other positions along the length of sleeve 20.

In the preferred embodiment shown, snap fastener 44 is utilized to selectively close opening 46 between upper flap portion 40 and lower flap portion 42. Snap fastener 44 is preferably discrete and mounted flush with the fabric in upper flap portion 40 and lower flap portion 42 so as to minimize interference with the wearer's arm in sleeve 20. Other fastening or retaining means, for example, the hook and loop closure means commonly distributed under the trademark VELCRO, could also be readily utilized to selectively close opening 46.

In certain preferred embodiments, opening 46 provides access through fixed liner 24 to interior surface 32 of outer fabric 22. Thus, upper flap portion 40 and lower flap portion 42 can be readily opened to provide access to interior surface 32 of outer fabric 22 to allow patch or other insignia 28 to be stitched to exterior surface 30 of outer fabric 22. After patch or other insignia 28 has been secured, penetrations in outer fabric 22 caused by stitching 34 can be readily repaired by conventional means on interior surface 32 of outer fabric 22. Thus, the weather resistant properties of a weather resistant fabric material would be maintained after the installation of patch or other insignia 28, without necessitating the removal or alteration of fixed liner 24. This allows patch or other insignia 28 to be readily installed to a jacket or similar garment after fixed liner 24 has been previously stitched to outer fabric 22.

From the preceding description of preferred embodiments of the present invention, it is evident that the objects of this invention are attained and, although the invention has been described and illustrated in detail, it is to be clearly understood that the same is by way of illustration only and is not to be taken by way of limitation. The spirit and scope of the invention are to be limited only by the terms of the appended claims.

What is claimed is:

1. A jacket or similar garment, comprising:

body portion including at least one arm hole opening therein;

sleeve portion including outer fabric and fixed lining, said sleeve portion extending from said arm hole opening;

said outer fabric including exterior surface and interior surface;

first means for permanently affixing said fixed lining to said outer fabric so access to said interior surface of said outer fabric is precluded from the interior of said jacket or similar garment; and second means for providing access to said interior surface of said outer fabric through said fixed lining to permit stitching of patch or other insignia to said exterior of said outer fabric without removal of said fixed lining from said sleeve portion and without penetrating said fixed lining.

2. The jacket or similar garment of claim 1, wherein said first means for permanently affixing said fixed lining to said outer fabric comprises stitching said fixed lining to said outer fabric.

3. The jacket or similar garment of claim 21, wherein said sleeve portion extends from said arm opening to a cuff end and said second means for providing access to said interior surface of said outer fabric through said fixed lining is located intermediate said arm opening and said cuff end.

4. The jacket or similar garment of claim 3, wherein said fixed lining includes upper flap portion and lower flap portion, and opening between said upper flap portion and said lower flap portion provides access to said interior surface of said outer fabric.

5. The jacket or similar garment of claim 4, wherein said upper flap portion extends downward beyond and overlaps said lower flap portion.

6. The jacket or similar garment of claim 5, further including fastening means for detachably securing said upper flap portion to said lower flap portion.

7. The jacket or similar arrangement of claim 6, wherein said outer fabric is fabricated from weather resistant fabric material, and said opening between said upper flap portion and said lower flap portion provides access to said interior surface of said outer fabric for sealing penetrations resulting from stitching insignia on said exterior surface of said outer fabric.

8. The jacket or similar garment of claim 3, wherein said outer fabric is fabricated from a weather resistant fabric material, and said second means provides access to said interior surface of said outer fabric for sealing penetrations in said weather resistant fabric material.

9. The jacket or similar arrangement of claim 3, wherein said outer fabric is fabricated from weather resistant fabric material and said second means provides access to said interior surface of said outer fabric for sealing penetrations in said weather resistant fabric material resulting from stitching insignia on said exterior surface of said outer fabric.

10. A sleeve for a jacket or similar garment, comprising:

outer fabric portion including interior surface, exterior surface and arm opening;

fixed lining positioned inside said outer fabric portion;

first means for permanently affixing said fixed lining to said outer fabric portion so access to said interior surface of said outer portion is precluded from the interior of said jacket or similar garment; and second means for providing access to said interior surface of said outer fabric portion through said fixed lining to permit stitching of patch or other insignia to said exterior surface of said outer fabric portion without removal of said fixed lining from said outer portion and without penetrating said fixed lining.

11. The jacket or similar garment of claim 10, wherein said first means for permanently affixing said fixed lining to said outer fabric portion comprises stitching said fixed lining to said outer fabric portion.

12. The jacket or similar garment of claim 11, wherein said sleeve extends from said arm opening to a cuff end and said second means for providing access to said interior surface of said outer fabric portion through said fixed lining is located intermediate said arm opening and said cuff end.

13. The sleeve of claim 12, wherein said fixed lining includes upper flap portion and lower flap portion, and opening between said upper flap portion and said lower flap portion provides access to said interior surface of said outer fabric portion.

14. The sleeve of claim 13, wherein said upper flap portion extends downwardly beyond and overlaps said lower flap portion.

15. The sleeve of claim 14, further including fastening means for detachably securing said upper flap portion to said lower flap portion.

16. The sleeve of claim 15, wherein said outer fabric is fabricated from weather resistant fabric material, and said opening between said upper flap portion and said lower flap portion provides access to said interior surface of said outer fabric portion for sealing penetrations in said weather resistant fabric material resulting from stitching insignia on said exterior surface of said outer fabric portion.

17. The sleeve of claim 12, wherein said outer fabric portion is fabricated from weather resistant fabric material, and said second means provides access to said interior surface of said outer fabric portion for sealing penetrations in said weather resistant fabric material.

18. The sleeve of claim 12, wherein said outer fabric is fabricated from weather resistant fabric material, and said second means provides access to said interior surface of said outer fabric portion for sealing penetrations in said weather resistant fabric material resulting from stitching insignia on said exterior surface of said outer fabric portion.

19. A method of securing a patch or other insignia to an exterior surface of a sleeve of a jacket or similar garment having an interior lining permanently attached to so that no access is available to said sleeve from the interior of said jacket or other garment, comprising the sequential steps of:

providing an opening in said interior lining;

opening said opening to provide access to an interior surface of said sleeve;

stitching said patch or other insignia to said exterior surface of said sleeve without penetrating said interior lining; and reclosing said opening.

20. The method of securing a patch or other insignia to an exterior surface of a sleeve of a jacket or similar garment of claim 19, wherein said interior lining includes an arm hole end and a cuff end and said opening is positioned intermediate said arm hole end and said cuff end.

21. The method of securing a patch or other insignia to an exterior surface of a sleeve of a jacket or similar garment of claim 20, wherein said interior lining includes an upper flap portion and a lower flap portion, and said opening is located adjacent said upper flap portion and said lower flap portion.

22. The method of securing a patch or other insignia to an exterior surface of a sleeve of a jacket or similar garment of claim 21, wherein said upper flap portion extends downward beyond and overlaps said lower flap portion.

23. The method of securing a patch or other insignia to an exterior surface of a sleeve of a jacket or similar garment of claim 22, further including fastening means for detachably securing said upper flap portion to said lower flap portion.

24. The method of securing a patch or other insignia to an exterior surface of a sleeve of a jacket or similar garment of claim 23, wherein said sleeve is fabricated from a weather resistant fabric material, and said opening provides access to said interior surface of said sleeve for sealing penetrations in said weather resistant fabric material resulting from stitching said patch or other insignia on said exterior surface of said sleeve.

* * * * *